United States Patent [19]

Hamilton et al.

[11] 4,233,831

[45] Nov. 18, 1980

[54] METHOD FOR SUPERPLASTIC FORMING

[75] Inventors: C. Howard Hamilton, Thousand Oaks; Edward D. Weisert, Rolling Hills Estates, both of Calif.

[73] Assignee: Rockwell International Corporation, El Segundo, Calif.

[21] Appl. No.: 875,279

[22] Filed: Feb. 6, 1978

[51] Int. Cl.[3] ..... B21D 26/04

[52] U.S. Cl. ..... 72/60; 72/342; 72/364

[58] Field of Search ..... 72/60, 19, 20, 702, 72/364, 342

[56] References Cited

U.S. PATENT DOCUMENTS

| | | | |
|---|---|---|---|
| 3,340,101 | 9/1967 | Fields et al. | 72/364 X |
| 3,920,175 | 11/1975 | Hamilton et al. | 228/173 |
| 3,927,817 | 12/1975 | Hamilton et al. | 228/157 |
| 3,934,441 | 1/1976 | Hamilton et al. | 72/342 |
| 4,023,389 | 5/1977 | Dibble et al. | 72/38 |

*Primary Examiner*—Leon Gilden

*Attorney, Agent, or Firm*—Charles T. Silberberg

[57] ABSTRACT

A method is provided for controlling the strain rate during superplastic forming of a blank of material into a part. The method produces a part in a minimum time by deforming the material under suitable-optimum superplastic conditions. A relationship is determined between time and the pressure required to form the blank against the configured surface of a die at a strain rate which causes the blank to flow superplastically. The blank is positioned in the die and held at a temperature at which the material exhibits superplasticity. Pressure is applied to the blank in accordance with the previously determined relationship between time and pressure until the part is formed.

8 Claims, 9 Drawing Figures

METHOD FOR SUPERPLASTIC FORMING

BACKGROUND OF THE INVENTION

A. Field of the Invention

This invention relates to the field of material forming, particularly to material forming under superplastic conditions.

B. Description of the Prior Art

Forming methods which are normally used to capitalize on superplasticity in selected materials involve the use of fluid (preferably gas) pressure to cause sheet material deformation and a configurational die into which the part is formed. Patents have been issued which relate to this process, e.g., U.S. Pat. No. 3,340,101 and 3,934,441, and the process is being used increasingly for forming such parts as titanium sheet metal structures for aircraft. In addition to the forming of a single sheet of a superplastic material, other recent processes combine diffusion bonding with superplastic forming to produce complex structures, such as sandwich structures, e.g., U.S. Pat. No. 3,927,817, and reinforced structures, e.g., U.S. Pat. No. 3,920,175.

These patents normally employ fluid pressure forming and rely upon the superplastic properties of the material to achieve high tensile elongations and controlled thinning. Since the elongation and thinning characteristics of the material being formed are related to the rate of straining, the rate of pressure application is critical to the successful fabrication of parts. Prior to this invention, the rate of pressure application was established by a trial-and-error method, resulting in much longer forming times than is possible by controlled strain-rate forming and uncertainty that suitable conditions for superplastic behavior were being sustained. Typically, the prior art method was conducted by slowly increasing the pressure applied to the metal blank to a maximum value which was then sustained to complete the forming. Both the rate of pressure increase and the maximum pressure was determined by trial and error. The goal of the empirically developed pressurization cycles was the forming of the metal blank without rupture, i.e., within the range of strain rates where superplastic behavior is pronounced.

Accordingly, prior art methods required time consuming and expensive trial and error testing and were still not capable of utilizing optimum or assuring necessary forming rates during the entire forming process, resulting in excessively long forming times. Attempts to increase the forming rate resulted in rupturing the part because the strain rate required for superplastic forming was exceeded during critical times in the forming operation. These problems have severely limited the widespread application of this promising method of forming utilizing superplastic properties of some metals and other materials.

SUMMARY OF THE INVENTION

It is an object of the invention to provide a reliable method for superplastically forming parts.

It is an object of the invention to provide a method for superplastically forming parts utilizing optimum or near optimum forming rates during the entire forming operation so that the time required to form a part is reduced.

It is an object of the invention to provide a method for controlling the strain rate within a superplastic range during forming of a part.

It is an object of the invention to provide a method wherein the optimum strain rate during superplastic forming of metal and/or plastic parts is determined.

According to the invention, the strain rate of a metal or plastic blank being formed is controlled during the entire forming operation to best utilize the superplastic properties of the material. From the strain rate sensitive properties of the material to be formed and the elongation requirements of the configuration to be formed, an optimum or suitable strain rate for superplastic behavior is determined. A relationship is determined between time of forming and the fluid pressure applied to the principle surfaces of the forming sheet to create the forming stresses necessary to assure that deformation throughout the forming cycle takes place, nominally, at the strain rate previously determined. Since the applied fluid pressure will be uniform over the forming part, the pressure-time relationship is developed for the most critical location of the forming part. The blank is positioned in the die and held at a temperature at which the material exhibits superplasticity. Fluid pressure is applied across the blank in accordance with the previously determined relationship between time and pressure until the part is formed.

These and other objects and features of the present invention will be apparent from the following detailed description, taken with reference to the accompanying drawings.

While the invention will be described in connection with the preferred embodiments, it will be understood that it is not intended to limit the invention to those embodiments. On the contrary, it is intended to cover all alternatives, modifications, and equivalents that may be included within the spirit and scope of the invention as described by the appended claims.

DESCRIPTION OF THE PREFERRED EMBODIMENT

This invention relates to the forming of metallic alloys having superplastic characteristics. Metallic alloys having such characteristics have a composition and microstructure such that, when heated to within an appropriate range of temperature and when deformed within an appropriate range of strain rate, they exhibit unusually high tensile elongations with reduced tendency toward necking. Such alloys have characteristics indicated by the formula:

$$\sigma = K\dot{\epsilon}^m,$$

where: m = the strain rate sensitivity,
$\sigma$ = stress,
$\dot{\epsilon}$ = stress rate, and
K = a constant.

The higher the value of m, the higher the tensile elongation (in the absence of strain hardening) prior to rupture. Normally, for m values in excess of 0.3, the extended ductility is referred to as superplasticity. However, this is an arbitrary value. Materials are capable of superplastic behavior if a maximum in the plot of m versus the log of the strain rate; $\dot{\epsilon}$, is exhibited (see for example FIG. 3). The required minimum m value can be determined by the desired elongation (see FIG. 8).

The value of m is a function of temperature, material, and microstructure, as well as of strain rate. Therefore, wide ranges in the value of m and the corresponding elongations can be developed for a given material as the rate of deformation changes. In studies of superplastic deformation under biaxial stress conditions such as bulging, the uniformity of thinning was shown also to correlate with the value of m. According to the present invention, an optimum or suitable strain rate is determined and this strain rate is controlled throughout the forming cycle to maintain sufficiently high values of m so that forming times are minimized, rupture and excessive localized thinning avoided, and the degree of elongation available is ample for the most critical location of the configuration to be formed.

Figure 1:
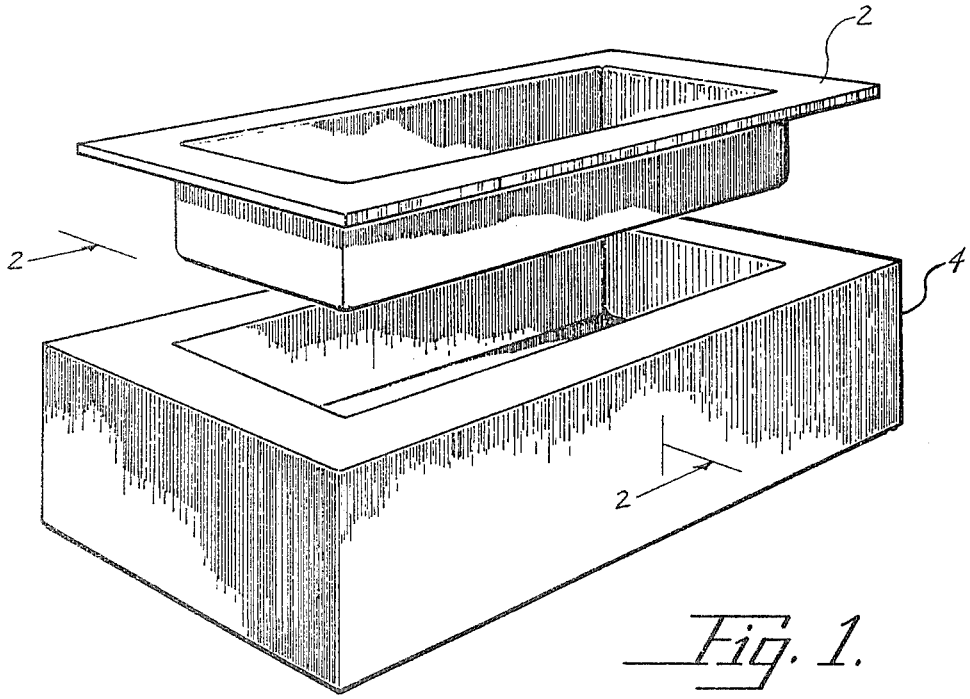
FIG. 1 is an exploded perspective view of a rectangular-shaped part used as an example to illustrate the method and a die used to form the part.

FIG. 1 is an exploded perspective view of a rectangular part 2 (as formed) and a die 4 used to illustrate the principles of the invention. As is usual in the superplastic forming of metals, a metal blank and die are heated to a temperature at which the material exhibits superplastic properties. Fluid pressure is applied to the blank causing the blank to flow into the die cavity and form against the die walls.

Figure 2:
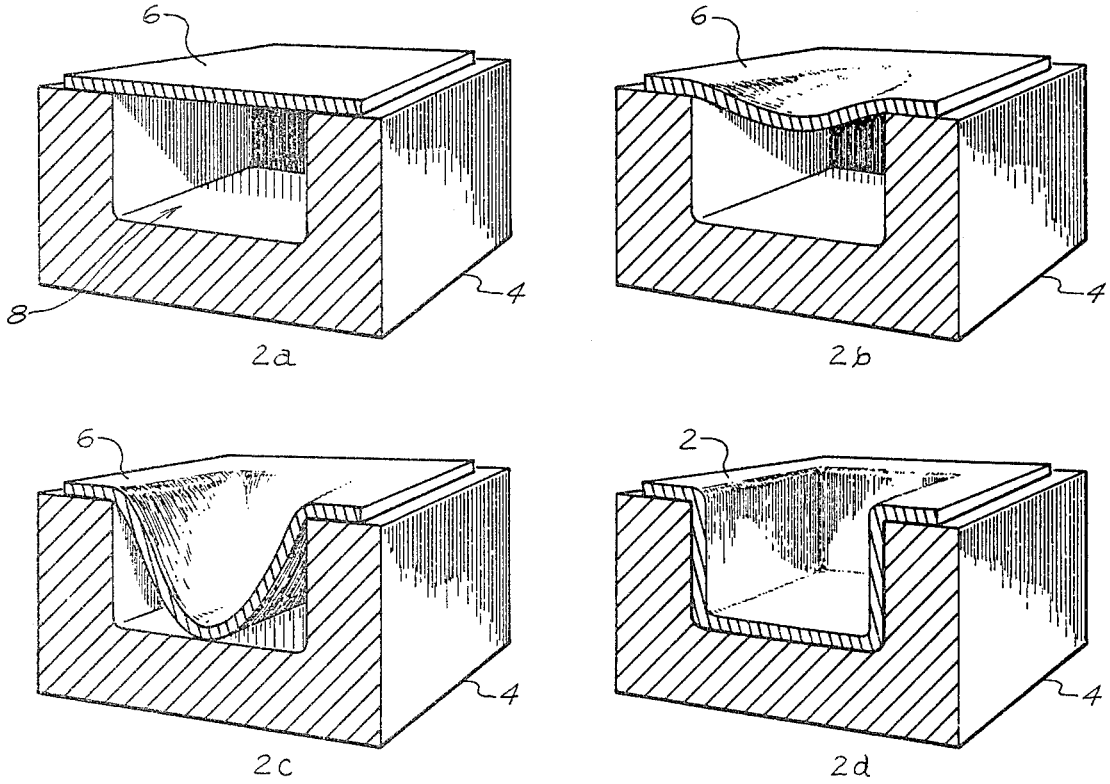
FIG. 2 shows the cross section of a die and a blank at several different stages in the superplastic forming procedure.

FIG. 2 illustrates different forming stages as blank 6 stretches into different shapes and comes into contact with the configured walls of die cavity 8. FIG. 2*a* shows a blank 6 positioned over die cavity 8 prior to forming. Pressure is applied to blank 6 in a manner well known in the art (such as disclosed in U.S. Pat. No. 3,934,441) causing the blank to flow into the cavity. During the first stages of forming, the blank is bulged freely into the cavity as shown in FIG. 2*b*. Eventually, the bulged portion of the blank touches the bottom of the die cavity as shown in FIG. 2*c*. The die bottom then supports a portion of the blank, greatly changing the stress distribution in the blank. At the final stage of forming, the blank 6 is formed in contact with the walls of the die cavity forming the part 2 as shown in FIG. 2*d*.

According to the present invention, the pressure applied to form blank 6 is varied (i.e., by adjusting valves which control the pressure such as described in U.S. Pat. No. 3,934,441) during the forming operation in a manner to provide a nominally suitable or optimum strain rate at all stages of the forming cycle. Since the shape, thickness, and location of blank 6 is continuously changing, the applied pressure must also be changed continuously to provide an optimum strain rate. This requires that a relationship be determined between time and the pressure required to form the blank against the surface of the die at a strain rate corresponding to the optimum or suitable value. Such a pressure vs. time profile may be determined analytically, experimentally, or by a combination of analytical and experimental methods. In most parts, the strain rate may vary from location to location, and the optimum or desired strain rate will according to the present invention be controlled for critical location of the part.

The critical location by the method of this invention is that cross-section of the configuration to be formed which for a given pressure application will be subjected to the largest elongation. The strain rate determined for this cross-section will be that which is high enough to minimize forming time while at the same time low enough to assure ample elongation is available for the most severe deformation required by the part configuration, i.e. as the strain rate exceeds a certain value, the m value decreases. The strain rate thus determined will tend to lie to the high strain rate side of the m value peak shown in FIG. 3. Thus, while the optimal or suitable strain rate value may be imposed by this method only at the critical cross-section, it is safe to assume that the spectrum of strain rates obtaining on all other locations in the part will be well within a region of suitable superplastic behavior.

Figure 3:
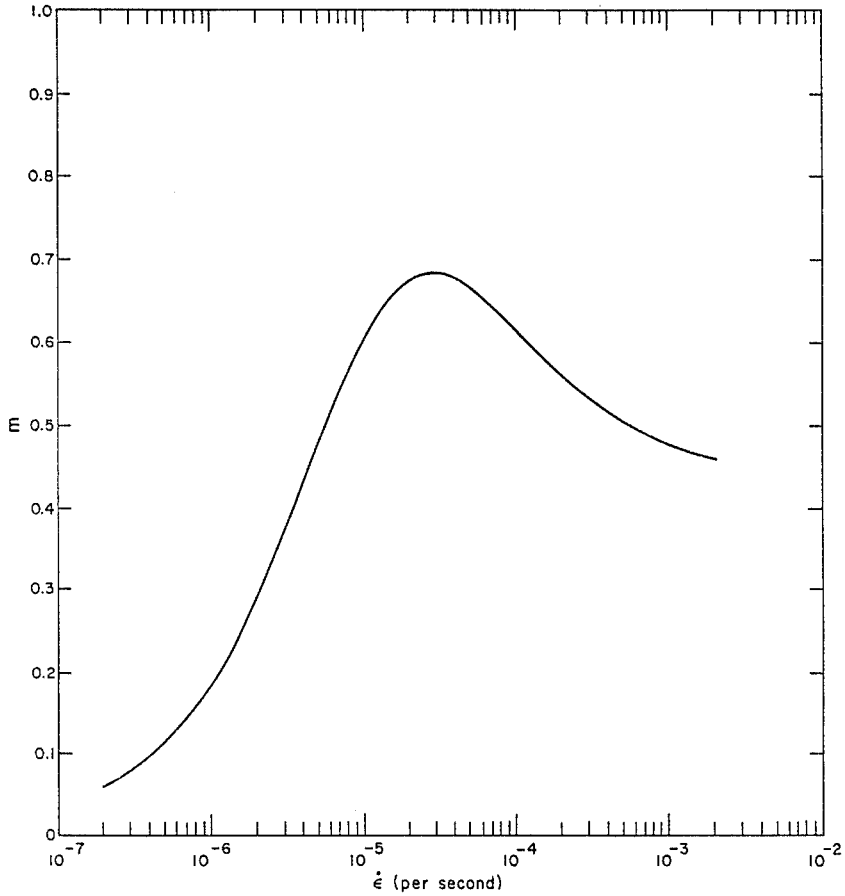
FIG. 3 is a curve showing a typical relationship between strain rate sensitivity, m, and strain rate, $\dot{\epsilon}$, for the titanium alloy, Ti-6Al-4V.
Figure 8:
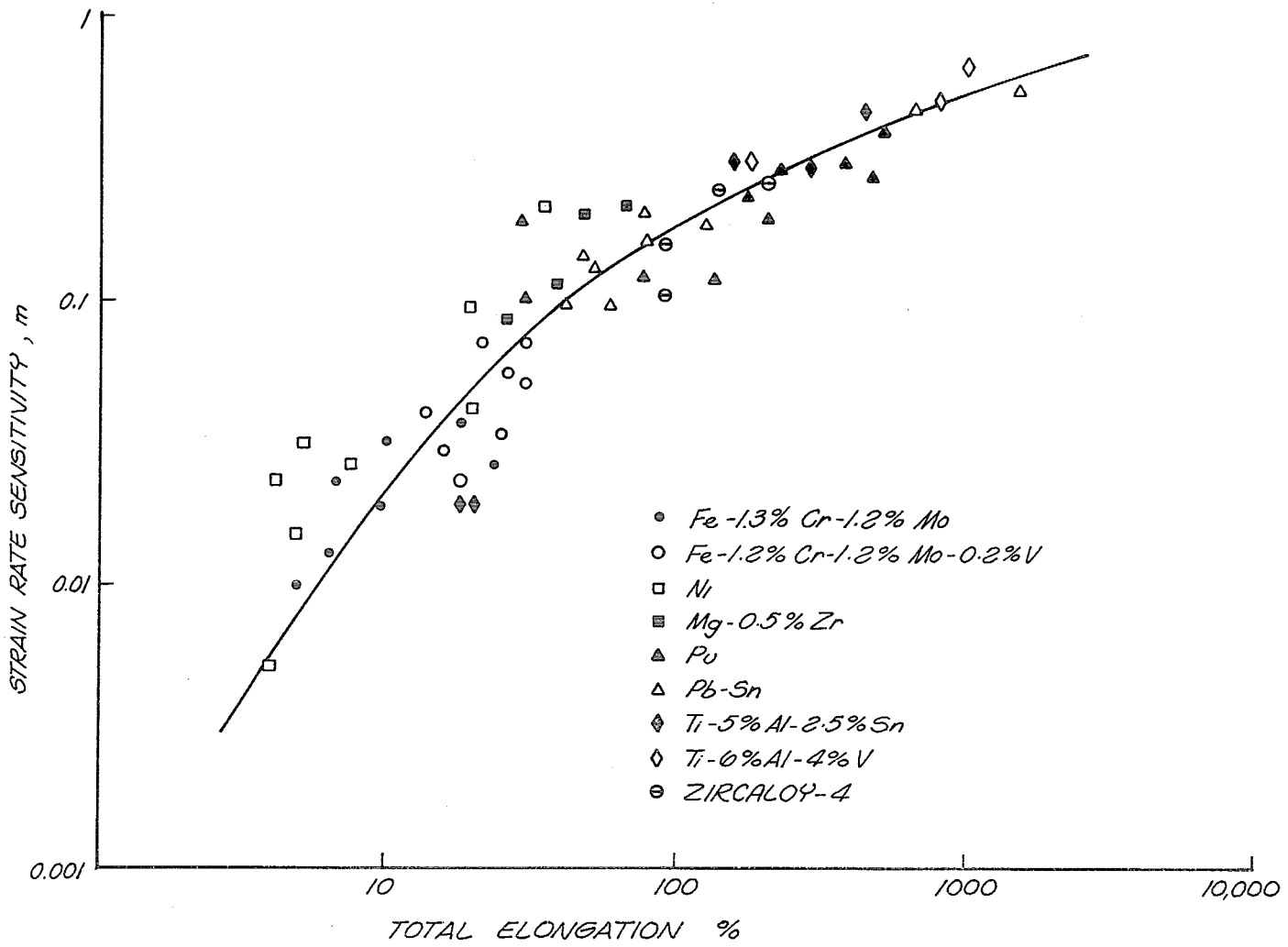
FIG. 8 shows the apparently universal relationship between strain rate sensitivity, m, and elongation available for forming prior to rupture.

An example of an analytical method to determine the pressure vs. time profile is presented in the following. To guide the selection of an optimal or suitable strain rate, a relationship between strain rate sensitivity, m, and strain rate, $\dot{\epsilon}$, is obtained for the material of interest. FIG. 3 shows such a relationship for a titanium alloy (Ti-6Al-4V) obtained at 1600° F. Methods for determining such relationship are well known, e.g., "Determination of Strain Hardening Characteristics by Torsion Testing," by Fields and Backofen, published in the Proceedings of the A.S.T.M., 1957, Vol. 57. Another relationship used is that between strain rate sensitivity, m, and total strain (elongation) at fracture as shown in FIG. 8. Using these relationships such as shown in FIGS. 3 and 8, a strain rate, $\dot{\epsilon}$, is selected which will provide a high value of strain rate sensitivity, m, which will also assure ample available elongation to meet the needs of the critical cross-section.

Figure 4:
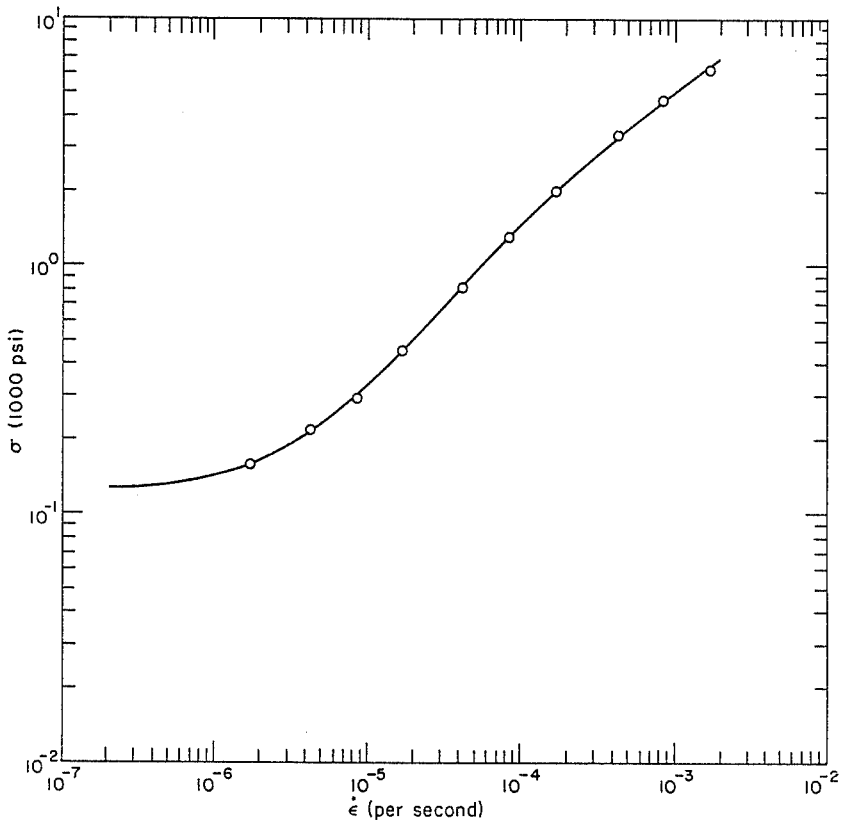
FIG. 4 is a curve showing the relationship between flow stress, $\sigma$, and strain rate, $\dot{\epsilon}$, at 1600° F.

A relationship is then obtained between flow stress, $\sigma$, and strain rate, $\dot{\epsilon}$, at the forming temperature, as shown in FIG. 4. Such relationship can be obtained by loading standard samples at varying strain rates and measuring the resulting flow stress. Using this relationship, the flow stress, $\sigma$, required to maintain the selected strain rate, $\dot{\epsilon}$, is determined. The selected flow stress is then used in conjunction with the geometry of the particular part to determine the relationship between time and pressure (the time vs. pressure profile) for forming the particular part.

For parts having a simple geometry, such as rectangular part 2, the relation between flow stress and pressure required to obtain the flow stress can be calculated during various stages of forming utilizing known mathematical relationships between pressure and stress in the part having the particular geometry. The following is an example of such a calculation for a rectangular part such as shown in FIGS. 1 and 2 having sufficient length to develop plane strain conditions within the center regions. The end effects are not considered in this analysis since experience has shown that the center area is most critical to successful forming. It is assumed that the material properties do not change substantially during the forming cycle, and therefore a constant effective strain rate, $\dot{\bar{\epsilon}}$, can be sustained if a constant effective flow stress, $\bar{\sigma}$, is generated in the forming diaphragm during the forming. If the von Mises criterion is assumed valid for these materials, the effective stress and strain rates are defined as follows for the plane strain condition:

$$\bar{\sigma} = \frac{1}{\sqrt{2}}\{(\sigma_r - \sigma_\theta)^2 + (\sigma_\theta - \sigma_z)^2 + (\sigma_z - \sigma_r)^2\}^{\frac{1}{2}} = \frac{\sqrt{3}}{2}\sigma_\theta \quad (1)$$

$$\dot{\bar{\epsilon}} = \frac{\sqrt{2}}{3}\{(\dot{\epsilon}_r - \dot{\epsilon}_\theta)^2 + (\dot{\epsilon}_\theta - \dot{\epsilon}_z)^2 + (\dot{\epsilon}_z - \dot{\epsilon}_r)^2\}^{\frac{1}{2}} = \frac{2}{\sqrt{3}}\dot{\epsilon}_r \quad (2)$$

where r, $\theta$, z=subscripts denoting coordinate directions, $\dot{\epsilon}$=strain rate, $\sigma$=flow stress, and $\dot{\epsilon}_r+\dot{\epsilon}_\theta+\dot{\epsilon}_z=0$ (plane strain).

In order to maintain constant effective stress, it is necess to impose sufficient fluid pressure to develop the constant stress, $\sigma_\theta$. If it is assumed that the forming diaphragm will maintain a cylindrical shape in those areas not contacting the die, and that the forming diaphragm is thin relative to the radium of curvature, the gas pressure can be expressed in terms of the stress $\sigma_\theta$ (and therefore):

$$P_i = \frac{t_i\,\sigma_\theta}{\rho_i} = \frac{2\,t_i\,\bar{\sigma}}{\sqrt{3}\,\rho_i} \quad (3)$$

where $\rho$=radius of curvature, t=thickness of the diaphragm, and i=a subscript denoting the stage of forming.

The radius of curvature can be expressed in terms of the height of the forming part of section, y, and the half-width of the part or forming section, $x_i$:

$$\rho_i = \frac{y_i^2 + x_i^2}{2y_i} \quad (4)$$

Figure 5:
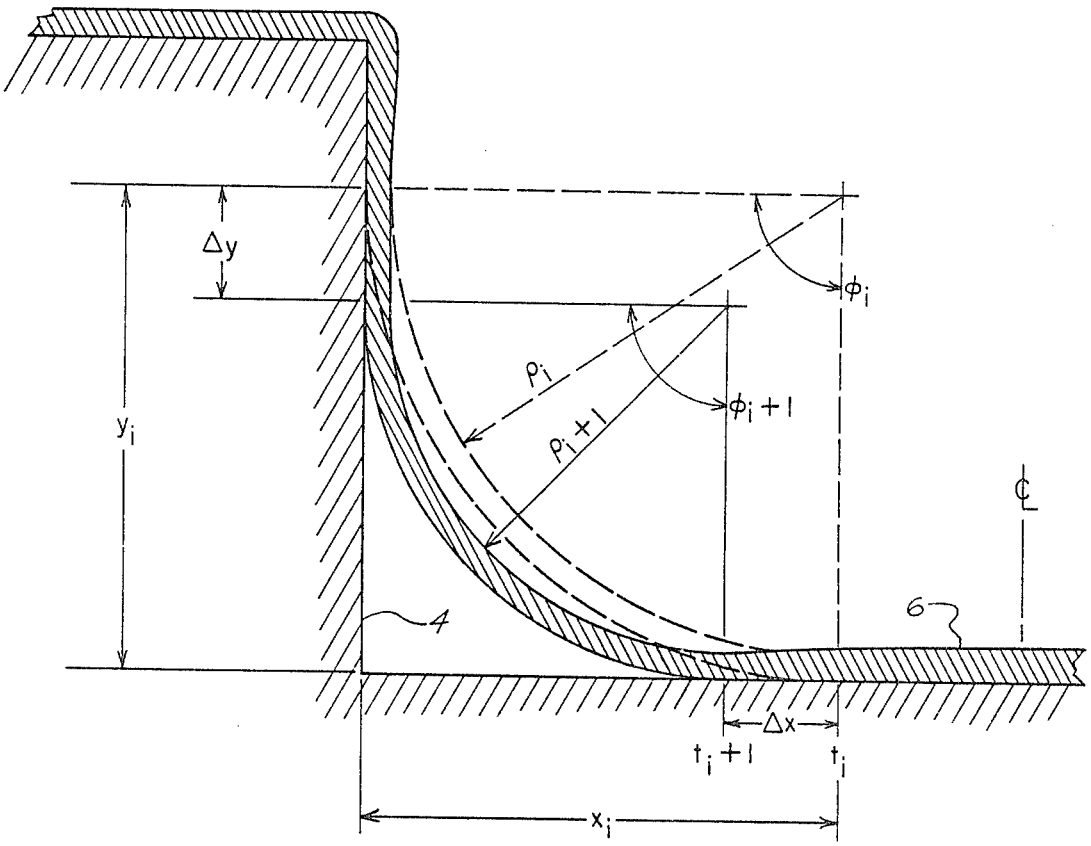
FIG. 5 is a thickness profile for a rectangular-shaped part during superplastic forming at 1600° F.

In order to compute the thickness, $t_i$, it is assumed that no sliding occurs between the part and the die, and the deformation occurs only in the cylindrical section. Therefore, a step-wise change in thickness can be determined as illustrated in FIG. 5:

$$t_{i+1} = \frac{t_i(\rho_i\phi_i - \frac{\Delta y}{2} - \frac{\Delta x}{2})}{\rho_{i+1}\,\phi_{i+1} + \frac{\Delta x}{2} + \frac{\Delta y}{2}}; \quad (5)$$

where:

$\phi=2\tan^{-1}(y_i/x_i)$, and $\Delta x$, $\Delta y$=length of the step increments of the x and y axis.

By combining Eqn. (3), (4), and (5), the pressure necessary to sustain constant effective stress, and therefore constant strain rate, can be established provided the extent of forming to a given time is known.

In order to arrive at the extent of forming as a function of time, it is recognized that constant strain rate has been induced throughout the forming cycle. Therefore, the time, $\xi_i$, lapsed to reach a given amount of effective strain, $\dot{\bar{\epsilon}}$, is:

$$\tau_i = \frac{\dot{\bar{\epsilon}}}{\dot{\bar{\epsilon}}}. \quad (6)$$

Figure 7:
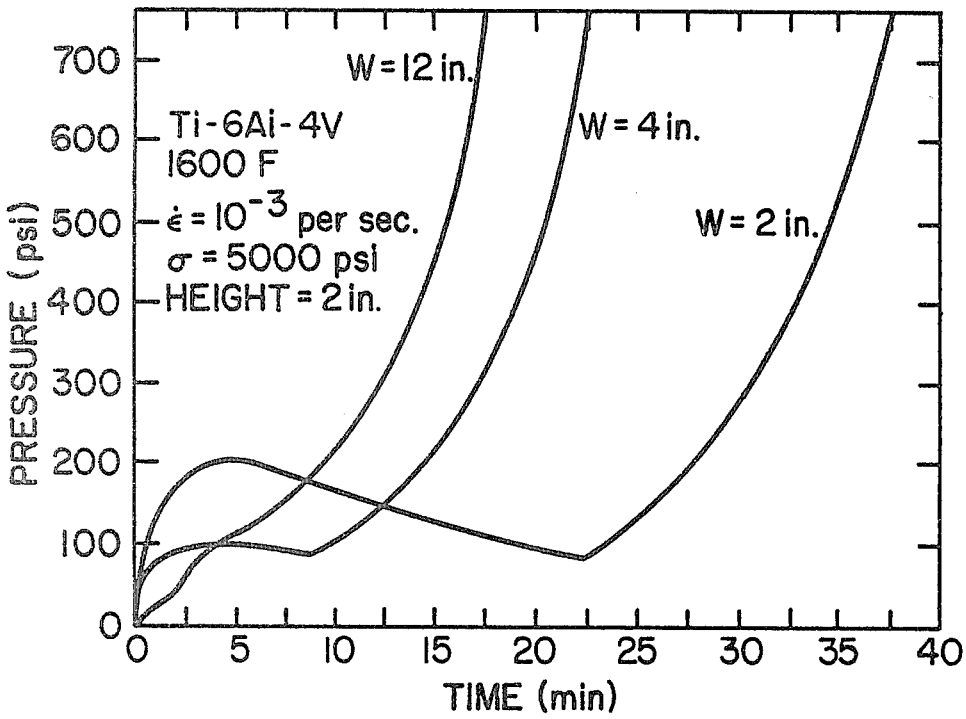
FIG. 7 shows three pressure vs. time profiles for forming rectangular-shaped parts having different width-to-height ratios.

This trade-off between changing thickness and radius of curvature is strongly dependent on the w/h ratio, and the corresponding pressure profiles can be quite different in reflection of this. An example of the influence of changing width on the pressure profile is illustrated in FIG. 7. In this example, all parameters other than the width were maintained constant. For the narrow, deep part in which w=2 (w/h=1), a significant portion of the profile involves decreasing pressure. This reflects the significant deformation which occurs after the half cylinder section is formed and before the diaphragm contacts the die bottom. During this part of the forming sequence, the radius of curvature is constant but the thickness is decreasing. Once the die bottom is contacted, the pressure rises rapidly, a common characteristic of each of the profiles shown.

For a wide part of w=12 (w/h=6) the pressure rises throughout the profile. This occurs because the forming diaphragm contacts the die bottom before the thinning dominates the process, and a decrease in pressure is not required. For the part of w=4 (w/h=2), the profile is identical in shape to that shown in FIG. 6 and for the same reasons as previously discussed.

Figure 6:
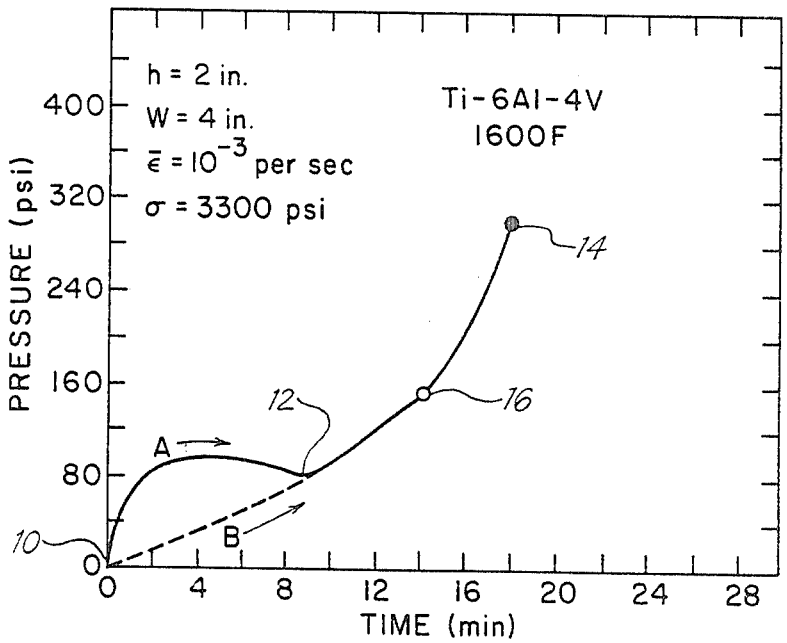
FIG. 6 is a pressure vs. time profile used for forming the blank shown in FIGS. 1 and 2 at 1600° F.

FIG. 6 is related to FIG. 2 in that point 10 is the start of forming (FIG. 2A), point 12 is the time when the blank first touches the floor of the die cavity (FIG. 2C), and the point 14 is the end of forming (FIG. 2D).

Profile B of FIG. 6 is an example of the prior art where the pressure/time relation was established by arbitrarily increasing the forming pressure gradually at the lower pressure levels. The part formed according to profile B ruptured at point 16, well before completion of forming, thus indicating the importance of utilizing a strain rate which is properly controlled throughout the forming operation to maintain the blank in a superplastic condition.

In applying the method of the present invention, it must be recognized that real parts will usually be of complex configuration so that uniform application of fluid pressure will not result in uniform rates of straining throughout the part during forming. Therefore, the part configuration must be analyzed and the critical or controlling cross-sectional location selected. Since it is an objective of this invention to achieve fast production rates by utilizing high strain rates (which may be safely applied), the critical location will usually be that which is configured so as to undergo the highest tensile deformation. If that location is controlled to an optimal or suitable strain rate, rupture will be avoided and all other locations will be safely formed at lesser strain rates.

Figure 9:
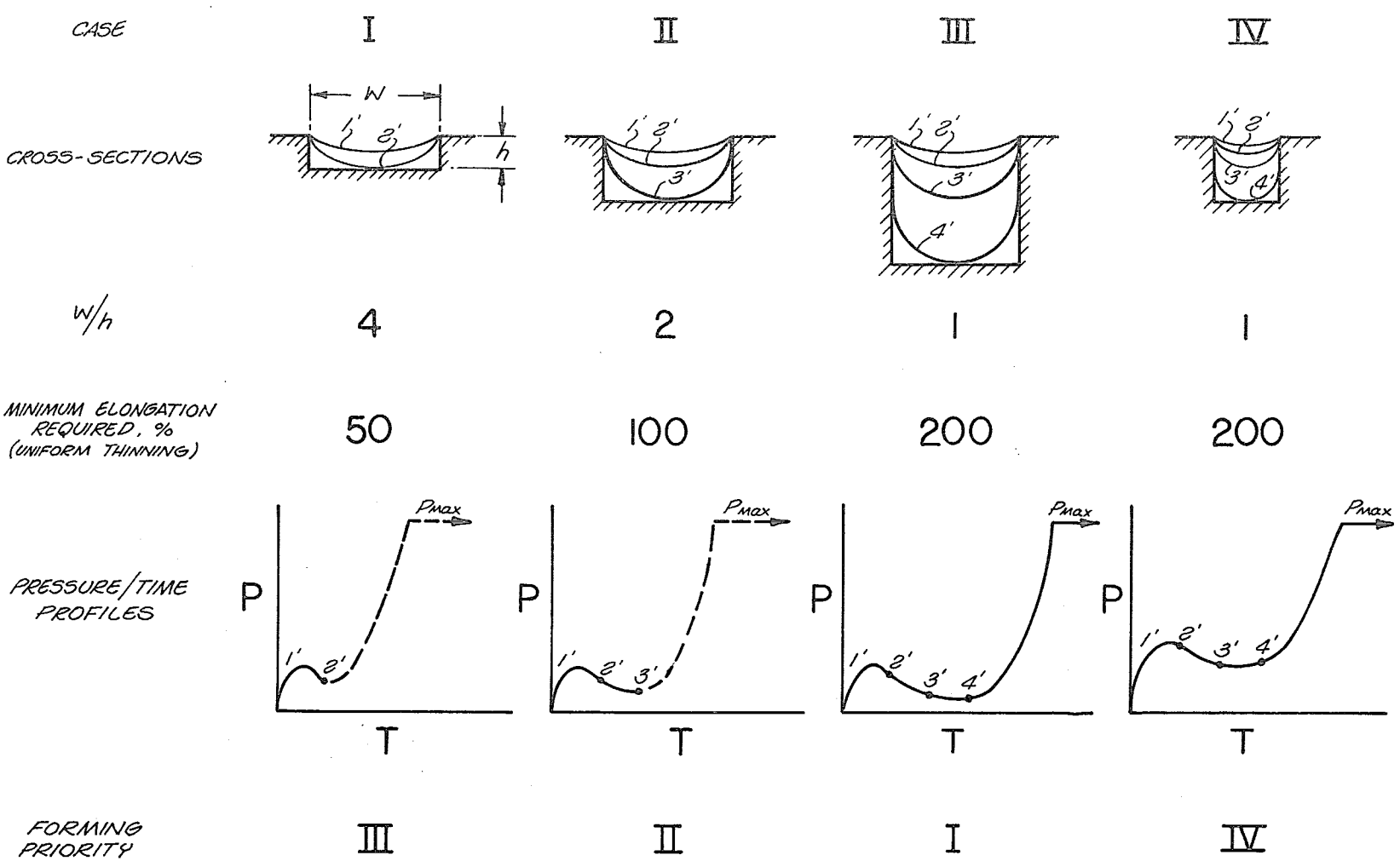
FIG. 9 illustrates the determination of the critical cross-sectional location in a given part configuration.

The selection of the critical cross-sectional location may be understood by refernce to FIG. 9. Cases I through IV are cross-sectional locations in a hypothetical part to be formed from a uniformly thick sheet. Cases I through III have equal widths (w) but vary in height (h). In Case I, the sheet completes free forming (stage 1') when it hits the die at point 2'. From then on pressure may be increased rapidly to the maximum imposed by practical considerations. In Case II, the forming sheet would reach point 2' at the same time as for Case I, however, it does not contact the die bottom at that point but continues to free form to point 3'. Since it is thinning faster than its radius of curvature is decreasing, the cross-section requires less and less pressure to sustain a constant stress and therefore strain rate. This may be seen from the pressure/time profile for Case II which decreases from point 2' to point 3'. If this were ignored and the pressure/time profile for Case I followed beyond point 2', the Case II cross-sectional location would be subjected to strain rates well above optimal and rupture would likely result. If, however, the profile of Case II is followed for Case I, the sheet would continue safely forming between points 2' and 3' at lower than optimal strain rates and would still be capable of sustaining the higher strain rates imposed after point 3'.

Consider next Case III where beyond point 3' the forming enters a second stage. Stage II forming is characterized by a constant radius of curvature while the thickness is continuously reduced so that pressure application to provide constant strain rate must also be reduced from point 3' to point 4' as indicated in the pressure/time profile for Case III. Clearly, the same reasons for selecting Case II over Case I apply and Case III takes priority as the critical cross-sectional location. If the part had only cross-sections I through III, the profile for Case III would be the correct one to follow in forming the part. It may be generalized that the part location requiring the largest degree of tensile deformation (elongation) will be the critical one.

The method of determining the critical cross-section has thus far considered only die cavities of equal width (w). If cavities of other widths exist, their requirements must be analyzed as, by example, with Case IV. The uniform thinning elongation requirements of Cases III and IV are equal, 200%. However, because of the smaller width (w) of the Case IV cavity, the radius of curvature ($\rho$) of the forming sheet is smaller at equivalent stages of forming. Since the sheet thickness is the same as for Case III, the forming pressures required for Case IV are universally higher than for Case III as seen by the schematic pressure/time profiles. To impose the Case IV pressure profile on any of the cases I through III would impose excessive strain rates. Therefore, Case IV has the lowest priority. The higher pressure requirements for Case IV can be handled by following the profile for Case III until it is past point 4' and then blending, without further pressure decrease, into the profile for Case IV (and thus a composite pressure/time profile results). At point 4', the cross-sectional criticality has switched from Case III to Case IV.

The above discussion assumes a uniform starting thickness of the sheet to be formed into each cross-sectional location on the part. This may not always be the case in that local variations in thickness may purposefully exist or be caused by prior forming. Such variations could alter the critical location, however, such variations will be taken into account by proper application of the described method.

As an alternate approach, or in conjunction with analysis, pressure/time relationship may be determined experimentally. The strains can be experimentally determined by marking a grid on the blank and measuring the grid dimensions at various stages of the forming sequence. This may be a preferred approach for particularly complex configurations. The strains required to form the blank to the various stages and corresponding strain rates can be determined from the changing grid dimensions in a manner well known to those skilled in the material and metal forming art.

Likewise, the pressure required at any time to sustain a constant rate of straining can be determined by experimental test. The strain can be established at a series of forming stages by the gridding technique discussed previously. The time corresponding to each of these strains is then determined by equation (6). The pressure can been be determined experimentally by establishing the pressure to achieve each increment of strain within the predetermined time period, $\Delta\tau$ $$\Delta\tau = \frac{\Delta\bar{\epsilon}}{\dot{\bar{\epsilon}}} \tag{8}$$

and $\Delta\bar{\epsilon}$ is the change in effective strain for the increment of forming being considered.

This technique to determine the incremental strain change can be one of periodic interruption of the forming test for a measurement of the grid, or it can be through the use of electrical indicators placed at required locations in the die surfaces to remotely identify when the forming part contacts those locations. The pressure for each strain increment can then be established by trial until an acceptable strain rate is achieved and the pressure noted.

The pressure profile can then be constructed by sequencing the imposed pressure required to achieve the controlled strain rate within each increment of strain with the time corresponding to the total strain imposed up to that increment.

Whether determined analytically or experimentally, use of such a pressure vs. time profile for a given part will cause the forming operation to be accomplished nominally at the selected optimal or suitable strain rate for all similar parts, provided the geometry, temperature, and material properties are not changed. Thus, once established, these forming parameters will permit the forming of production quantities of parts with minimum risk of tearing or excessive thinout, and with minimum forming time required.

Factors that determine the pressure profile include temperature of forming, thickness of the sheet, geometry, and specific material properties (i.e. flow stress as a function of strain rate) which may vary from batch-to-batch of a given material. However, once a pressure profile is established for a given part (i.e. fixed geometry), corrections can be readily made for changes in the variables of temperature, thickness, and material properties. For example, the pressure required is a linear function of thickness and flow stress so that the pressure profile can be readily corrected for either of these:

$$P_c = \frac{t_c}{t} \frac{\bar{\sigma}_c}{\bar{\sigma}} P \tag{9}$$

where the subscript c designates the changed conditions imposed, assuming that the strain rate is not to be changed. A change in temperature will result in a change in flow stress, $\bar{\sigma}$, and this effect will therefore be corrected by equation (9) also. In the above case, the time corresponding to each pressure level will remain unchanged provided the desired strain rate is not changed.

In some cases, it may be desired to alter the strain rate, as in the case where the strain sensitivity, m, properties are significantly different in different heats of materials or different alloys. In this case, a previously determined pressure profile may be corrected by adjusting both pressure and corresponding time. For the new strain rate, $\dot{\bar{\epsilon}}_c$, there will be a new flow stress, $\bar{\sigma}_c$, and the pressure can therefore be adjusted by equation (9). The time corresponding to the new pressure may then be determined by the following:

$$\tau_c = \frac{\dot{\bar{\epsilon}}_c}{\dot{\bar{\epsilon}}} \tau \qquad (10)$$

Thus, once a successful pressure vs. time profile is established for a given part configuration, it can be readily adjusted to accommodate changes in temperature, thickness, and material property variations, even for those parts of such complexity as to make analysis difficult or impossible.

It should be noted that this approach to forming will apply equally well to any material which exhibits strain rate sensitivity of flow stress, such as many metals, thermo-forming plastics, or superplastic intermetallic compounds such as $Ti_3Al$.

This method will be equally suitable for fluid pressure forming sheet materials, or fabrication of more complex parts requiring a combination of diffusion bonding and superplastic forming. For example, the reinforced structures as described in U.S. Pat. No. 3,920,175 can be accomplished with this device.

Numerous variations and modifications may be made without departing from the pressure invention. Accordingly, it should be clearly understood that the form of the present invention described above and shown in the accompanying drawings is illustrative only and is not intended to limit the scope of the present invention.

What is claimed is:

1. A method of forming a part comprising the steps of:

providing a blank of material having superplastic characteristics;

providing a die having a surface which is complementary to the shape of the part;

determining a relationship between time during forming and the pressure required to superplastically form said blank against said surface of said die at a suitable substantially constant strain rate;

positioning said blank relative to said die;

bringing said blank to within a temperature range at which said blank exhibits superplastic characteristics; and applying pressure of varying magnitude to said blank in accordance with said relationship between time and pressure to induce tensile stresses in said blank and superplastically form said blank against said surface of said die.

2. The method of claim 1 wherein said relationship between time and pressure is for the critical location of the configuration of said part.

3. The method of claim 2 wherein the critical location is at the cross-sectional area of said part requiring the maximum elongation of said blank.

4. The method of claim 2 wherein said critical location is variable during forming whereby said relationship between time and pressure is a composite relationship.

5. The method of claim 1 wherein said step of determining a relationship between time and pressure comprises:

determining the maximum elongation of said blank required for forming said part;

obtaining a relationship between strain rate sensitivity and strain rate, and a relationship between flow stress and strain rate within said temperature range;

selecting from said relationship between strain rate sensitivity and strain rate a suitable strain rate which meets said maximum elongation required;

selecting from said relationship between flow stress and strain rate a value of flow stress corresponding to said selected strain rate;

calculating strains required to form said blank to selected stages of forming based upon the change in geometry of said blank between said stages;

calculating times required to form said blank to each of said stages of forming by dividing said selected strain rate into each of said strains;

calculating the pressures required during forming to sustain said selected flow stress based upon the geometry of said blank at said stages of forming; and relating said calculated pressures to said times to obtain said relationship between time and pressure.

6. The method of claim 1 wherein said step of determining a relationship between time and pressure comprises:

determining the maximum elongation of said blank required for forming said part;

obtaining a relationship between strain rate sensitivity and strain rate, and a relationship between flow stress and strain rate within said temperature range;

selecting from said relationship between strain rate sensitivity and strain rate a suitable strain rate which meets said maximum elongation required;

selecting from said relationship between flow stress and strain rate a value of flow stress corresponding to said selected strain rate;

experimentally determining the strains required to form said blank between selected stages of forming by marking a test blank, forming said test blank to said selected stages, and measuring the change in the marked dimension;

calculating times required to form said blank to each of said stages of forming by dividing said selected strain rate into each of said determined strains;

experimentally determining the pressures required during forming to sustain said selected flow stress by forming test blanks at various pressures to said selected stages until the pressures are determined which are required to reach said selected stages within said calculated times; and relating said experimentally determined pressure to said times to obtain said relationship between time and pressure.

7. The method of claim 1 wherein said strain rate allows for the maximum elongation of said blank necessary for forming said part and requires substantially minimal forming time.

8. The method of claim 2 wherein said strain rate allows for the maximum elongation of said blank necessary for forming said part and requires substantially minimal forming time.

* * * * *